United States Patent [19]

Kilgore

[11] 4,360,063

[45] Nov. 23, 1982

[54] VALVE

[75] Inventor: Marion D. Kilgore, London, England

[73] Assignee: Otis Engineering Corporation, Dallas, Tex.

[21] Appl. No.: 212,995

[22] Filed: Dec. 4, 1980

[51] Int. Cl.[3] ..... E21B 34/10

[52] U.S. Cl. ..... 166/317; 166/318; 166/319; 166/313

[58] Field of Search ..... 166/317, 318, 319, 321, 166/325, 326, 328

[56] References Cited

U.S. PATENT DOCUMENTS

| | | | |
|---|---|---|---|
| 2,998,075 | 8/1961 | Clark, Jr. | 166/318 |
| 3,051,244 | 8/1962 | Litchfield | 166/317 |
| 4,292,988 | 10/1981 | Montgomery | 166/318 |

*Primary Examiner*—Stephen J. Novosad
*Assistant Examiner*—Joseph Falk
*Attorney, Agent, or Firm*—Vinson & Elkins

[57] ABSTRACT

A method and apparatus especially adapted for use with an injection well in which a valve controlled H-member interconnects the two tubings of a two tubing installation and landing nipples are attached to the lower legs of the H-member to receive expendable fluid control means, such as standing valves, in which pressure applied to one tubing to create a pressure differential will move the valve controlling the interconnection between the H-members to open position to permit TFL operations to be carried out in the well and thereafter pressure exerted on a ball supported on the valve member of the control valve for the H-member closes the control valve, and the ball passes through the control valve. The fluid control members in the landing nipples may be ejected either before or after closing of the valve in the H-member.

The standing valve shear pins may be sheared without releasing the valves from their supporting shoulders. When pressure approaches equalization the valves will pass through the supporting shoulders.

4 Claims, 3 Drawing Figures

VALVE

This invention relates to a flow control means and more particularly to a flow control means of the expendable type.

This invention provides an expendable flow control means which may be utilized in the injection well system disclosed in the invention of Arendt and Heard, U.S. Application Ser. No. 212,994 for Well System and Method, filed on even date herewith.

An object of this invention is to provide an expendable well control device which may be landed in a landing nipple and which is prepared for expulsion from the landing nipple upon being subjected to a selected pressure, but which will remain in the landing nipple until the pressure is thereafter reduced to approximately zero at which time the device will fall out of the landing nipple or will be expelled on the next occasion that the device is subjected to pressure.

Other objects, features and advantages of the invention will be apparent from the drawings, the specification and the claims.

In the drawings wherein like reference numerals indicate like parts, and wherein an illustrative embodiment of this invention is shown, FIG. 1 is a schematic view partially in elevation and partially in cross-section of a well equipped to practice this invention;

Figure 1:
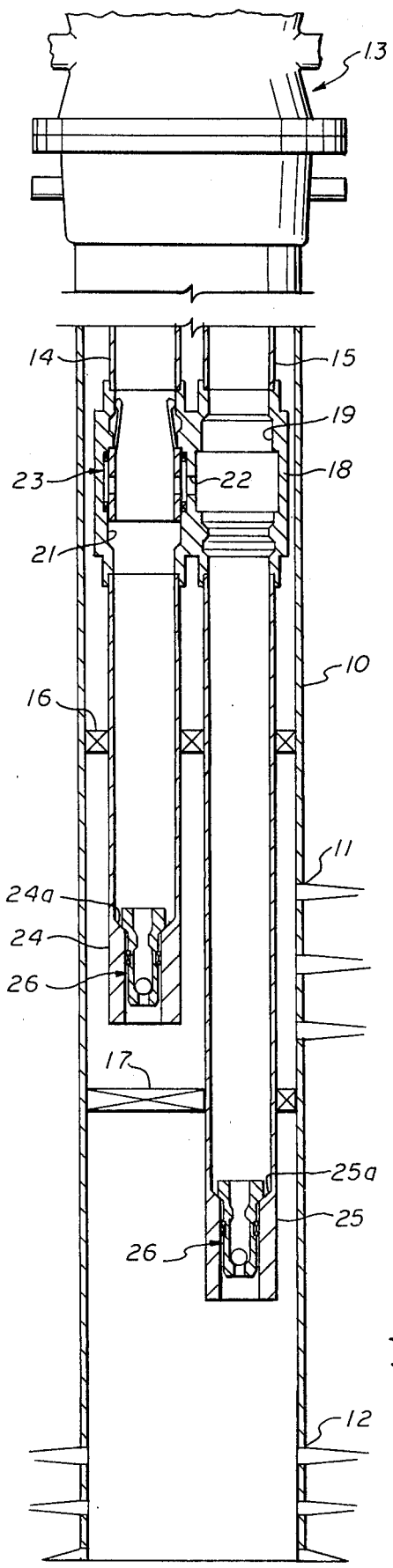

Referring to FIG. 1 an injection well is provided with a casing 10 perforated at 11 and 12 to provide for injecting fluids into two formations. The well has the usual wellhead indicated schematically at 13.

Within the well are suspended tubing 14 and 15 and suitable packers 16 and 17 pack-off between the two formations 11 and 12 and above formation 11.

Interconnecting the two tubings 14 and 15 is a H-member 18. This H-member has parallel bores 19 and 21 interconnected by a lateral passageway 22. The H-member carries a slide valve indicated generally at 23 for controlling flow through the lateral passageway 22.

Attached to the lower end of the H-member and in communication with the bores 19 and 21 are landing nipples 24 and 25. These landing nipples have no-go shoulders **24*a* and 25*a* adapted to support a flow control means such as the expendable standing valves indicated generally at 26**.

Figure 2:
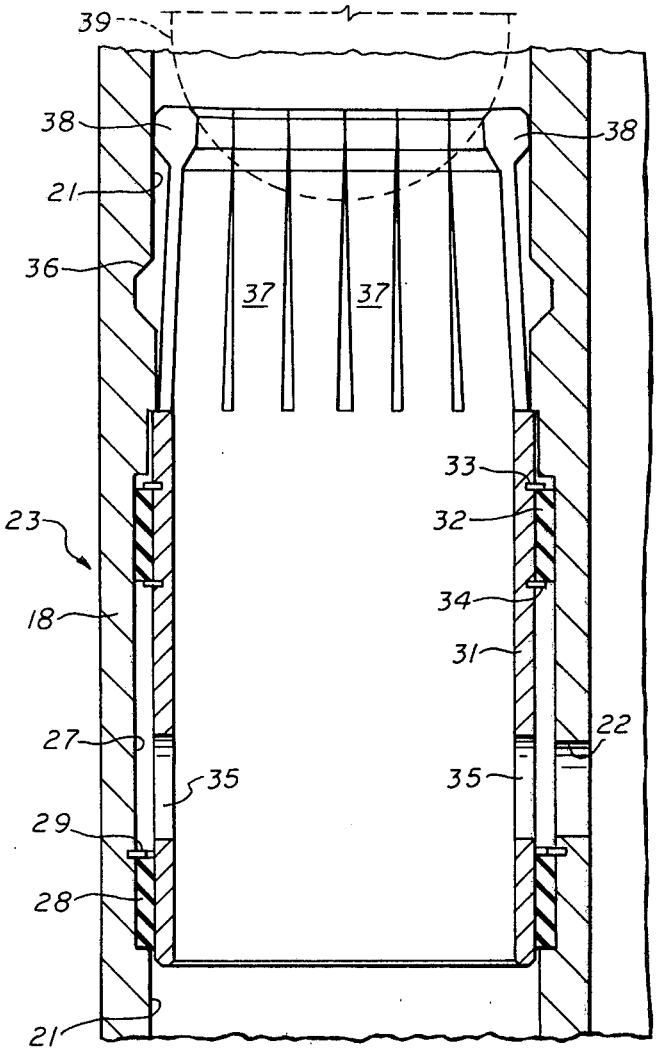
FIG. 2 is a fragmentary cross-sectional view of an enlarged scale showing the sleeve valve for the H-member and showing in dashed lines the lower section of a ball used in closing the valve.

Referring now to FIG. 2, there is shown a preferred form of valve 23 for controlling flow between the two tubings 14 and 15. This valve employs collets for supporting a pumpdown ball to move the collet downwardly as taught on Page 3949 of the 1974–1975 *Composite Catalog of Oil Field Equipment and Services.*

The H-member 18 has one bore such as bore 21 enlarged as at 27. Within the bore there is positioned a sliding seal 28 held in place by a C-ring 29.

Within the bore 21 there is positioned a sliding valve member 31 which sealingly engages seal 38 and carries seal 32 held in place by upper and lower C-rings 33 and 34. The seal member 32 slides within and is sealingly engaged with the enlarged bore 27. The valve member 31 is provided with ports 35 which register with the enlarged bore 27 when the valve member is in the upper position. These ports 35 are positioned below the seal member 28 when the valve 31 is in its lower position to control flow through the interconnecting passageway 22 within the H-member 18. When the valve is closed a selected differential between tubing 15 and 14 will exert a force upon the seal member 32 and when the pressure in tubing 15 is sufficiently greater than the pressure in tubing 14, the sliding valve member 31 will be moved to its upper position due to the effect of pressure on the pressure responsive area provided by the difference in diameter of the enlarged bore 27 and the outer diameter of the slide valve 31.

In the bore 21 and above the enlarged area 27, a circumferential groove 36 is provided. This groove 36 and the bore 21 thereabove cooperate with collet fingers 37 having enlarged lugs 38 on the free end thereof. When the sliding valve 31 is in its upper position, the collet fingers 37 are collapsed inwardly by the wall providing bore 21 and the fingers provide a circumferential shelf on which the pumpdown ball 39 may be landed.

As will be understood by those skilled in the art, the spaces between the lugs 38 on the collet fingers 37 may be dimensioned to be of close tolerance or provided with resilient material to restrict or prevent flow therethrough and/or the ball 39 may be made of resilient material or have a hard core with a resilient cover to inhibit or prevent flow of fluid through the collet fingers when the ball 39 is seated on the fingers.

In the operation of the slide valve an increase in pressure in tubing 15 to a selected value over the pressure in tubing 14 results in an upward force being exerted on the valve 31 to force the lugs 38 on the collet fingers from groove 36 to move the valve to its upper position as shown. In this position the collet fingers are retracted. When it is desired to close the valve, a ball 39 is dropped into tubing 14 and pressure is exerted in tubing 14 to move the ball downwardly and close the slide valve 23. When the valve closes the lugs 38 expand into groove 36 and permit the ball 39 to fall through the slide valve member 31. The lugs hold the slide valve in closed position.

Figure 3:
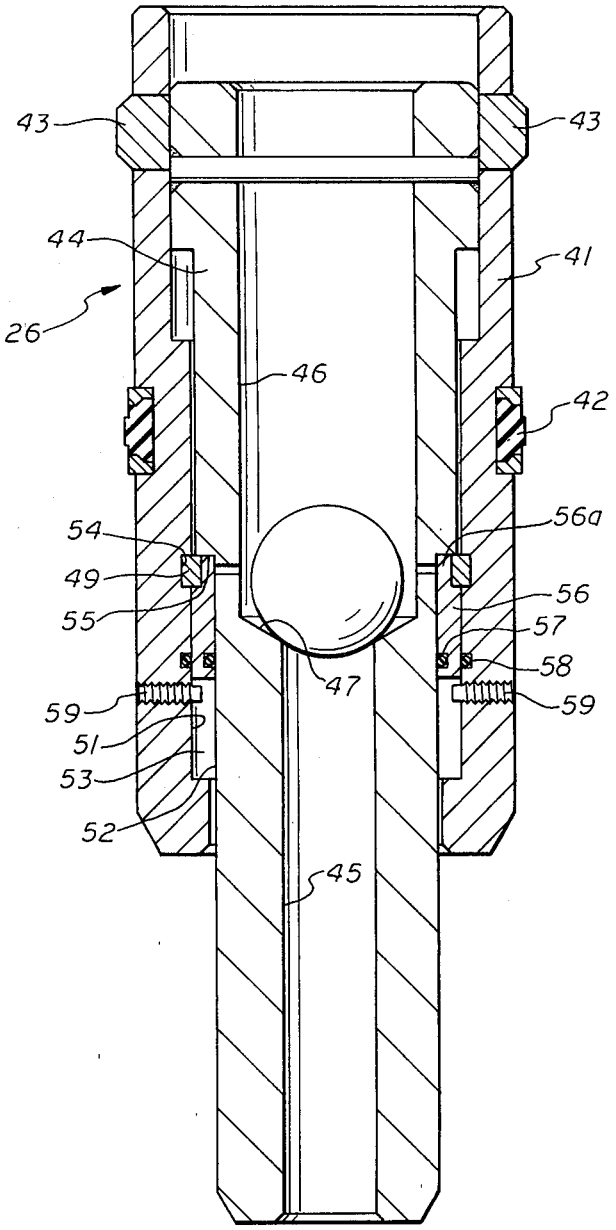
FIG. 3 is an enlarged view in cross-section of the expandable flow control of this invention.

Referring to FIG. 3 wherein the flow control of this invention is shown, the expendable flow control 26 includes a body 41. A suitable seal 42 on body 41 will seal with the landing nipple.

The body carries a plurality of latch lugs 43 which are dimensioned to land on the shelf **24*a* and 25*a* of landing nipples 24 and 25. The seal 42** seals with the bore through the landing nipple.

A first prop-out means 44 is provided in said body and is slidable therewith between an upper position in which it props-out the first latch means 43 and a lower position in which these lugs are released.

Preferably, the flow control means is a standing valve and for this purpose the prop-out 44 has a bore 45 therethrough and a counter bore 46 providing a seat 47 with which the ball 48 cooperates to provide a check valve.

The first prop-out 44 is maintained behind the lugs 43 by a C-thrust ring 49. The body 41 has an internal bore 51 which is spaced from an external section 52 of the prop-out 44 to provide an annulus 53 therebetween. The thrust ring 49 is expanded into a groove 54 in the body 41. This groove faces into the annulus 53.

The first prop-out 44 has a downwardly facing shoulder 55 which engages the upper surface of the thrust ring 49 and prevents downward movement of the prop-out 44 while the thrust ring 49 resides within the groove 54 in the body 41.

A pressure responsive second prop-out means is provided by a piston 56 having a sliding seal 57 with the prop-out 44 and sliding seal 58 with the body 41. This piston 56 has an upper reduced diameter section 56*a* which props-out the thrust ring 49 in its expanded position while the piston 56 is in its upper position. The piston 56 is held in its upper position by shear pins 59 until the flow control is subjected to a pressure differential there across which will provide a force on piston 56 sufficient to shear the pins 59.

In operation of the flow control, application of a sufficient force by downward pressure within the tubings 14 or 15 upon piston 56 shears pins 59 and causes the piston to move to its lower position, whereupon the section 56*a* of the piston is removed downwardly from behind the thrust ring 49. As this pressure will be exerting a force downwardly on the prop-out 44, the frictional engagement between the shoulder 55 of the prop-out and the thrust ring 49 will maintain the thrust ring expanded and the flow control will remain in position in the landing nipple. However, thereafter as the pressure within the tubings 14 and 15 is reduced, the force exerted on the prop-out 44 will reduce and at approximately the time that this force exerted on the prop-out 44 by the differential in pressure there across reaches zero the frictional engagement between the prop-out 44 and the thrust ring 49 will lessen and the thrust ring 49 will contract to its unstretched position at which time it will be freed from the body groove 54 and the prop-out 44 is free to move downwardly to a position releasing the prop-out lugs 43. The flow control may at this time fall free from the landing nipple under its own weight. If, however, the frictional engagement between the several components of the flow control and the landing nipple prevent the flow control from falling under its own weight it will be expended from the landing nipple the next time pressure is applied to the system in amounts sufficient to overcome the frictional engagement between the flow control and the landing nipple.

In the operation of the system shown in FIG. 1, the differential pressures utilized in opening and closing the slide valve 23 will normally be less than the pressure required to shear pins 59 in the flow control units.

In converting the well from injection to TFL operations the flow control devices are dropped into the tubing and landed in the landing nipples 24 and 25. Thereafter, pressure is increased in tubing 15 to a sufficiently greater pressure than that present in tubing 14 to move the slide valve from its lower to its upper or open position.

TFL procedures may thereafter be utilized to carry out desired procedures within the well.

When it is desired to return the system to injection conditions, the ball 39 is dropped in tubing 14 and landed upon the slide valve dogs 38. At this time a differential is preferably established with the higher pressure in the tubing 14 to move the slide valve 23 to closed position. After the slide valve has been moved to closed position, pressure in both tubings are increased to a value at which the shear pins 59 of both flow control units are sheared. A substantially greater pressure may be utilized to insure that both sets of shear pins have sheared.

It is, of course, possible to raise the pressure of both tubings by an equal amount until after the pins have sheared and then to establish the desired differential by varying the relative pressures in tubings 14 and 15 to shift slide valve 23 to closed position.

Thereafter, the pressure in both tubings may be reduced to remove the force from across the two flow control means and permit them to drop out or to be expended on the next application of pressure. However, it is preferred to check the position of the slide valve and make certain that it is closed by first reducing the pressure in one tubing while maintaining the pressure in the other tubing. If the slide valve 23 is closed the pressure, of course, can be maintained, but if not, the pressure in the other tubing will reduce and remedial measures should be taken to insure that the slide valve is closed.

After it is certain that the slide valve 23 is closed, pressure in tubing 14 and 15 can be reduced to remove the pressure from across the control valves and permit them to fall out of place, or to be ejected when the well is placed back on injection procedures.

This invention may also be practiced utilizing the disclosure in the application of E. Fisher, Ser. No. 212,996 for Locking Mandrel, filed on even date herewith, the disclosure of which is incorporated herein in its entirety by reference.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. An expendable flow control comprising, a body, first latch means extensible from said body, first prop-out means movable between an upper position proping out first latch means and a lower position releasing said first latch means, second latch means preventing downward movement of said first prop-out means while the latch means is extended and while said flow control is subjected to a force thereacross, pressure responsive second prop-out means holding said second latch means extended, and means preventing movement of said second prop-out means until it is subjected to a selective force whereupon said second prop-out means releases said second latch means, and upon removal of said force across the flow control, said second latch means releases said first prop-out means which in turn releases said first latch means.

2. The flow control of claim 1 wherein the first prop-out means has a bore therethrough and a check valve controlling flow through said bore.

3. An expendable flow control comprising, a body, seal means on the exterior of said body, latch lugs carried by said body and adapted to extend radially from said body to land on a shoulder in a landing nipple, sliding prop-out means in said body movable between an upper position holding said lugs extended and a lower position releasing said lugs for retraction to release them from a landing nipple, an annulus between said body and said prop-out means, a downwardly facing shoulder on said prop-out means, a groove in the body facing said annulus, a split ring expanded into said groove and engaging said downwardly facing shoulder on the prop-out means, a piston slidable in said annulus and in its upper position maintaining said thrust ring expanded, seal means between said piston and each of said body and prop-out means, and a shear pin releasably holding said piston in its upper position, said piston moving from behind said split ring when subjected to a force sufficient to shear said shear pin and releasing said thrust ring for contraction into said annulus.

4. The flow control of claim 3 wherein the prop-out means has a bore therethrough and a check valve controlling flow through said bore.

* * * * *